US010935916B2

(12) United States Patent
Hashimoto

(10) Patent No.: US 10,935,916 B2
(45) Date of Patent: Mar. 2, 2021

(54) SHEET CONVEYING DEVICE AND IMAGE RECORDING APPARATUS

(71) Applicant: BROTHER KOGYO KABUSHIKI KAISHA, Nagoya (JP)

(72) Inventor: Yohei Hashimoto, Nagakute (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/712,676

(22) Filed: Dec. 12, 2019

(65) Prior Publication Data

US 2020/0192264 A1 Jun. 18, 2020

(30) Foreign Application Priority Data

Dec. 14, 2018 (JP) ..... JP2018-234768

(51) Int. Cl.
*G03G 15/00* (2006.01)

(52) U.S. Cl.
CPC ..... *G03G 15/5062* (2013.01); *G03G 15/657* (2013.01); *G03G 15/6508* (2013.01)

(58) Field of Classification Search
CPC ..... G03G 15/5062; G03G 15/5095; G03G 15/6502; G03G 15/6555; G03G 15/6561
See application file for complete search history.

(56) References Cited

U.S. PATENT DOCUMENTS 9,651,912 B2 * 5/2017 Onishi ..... G03G 15/6564

FOREIGN PATENT DOCUMENTS

JP 11-134469 * 10/1997
JP 2006-298587 A 11/2006

* cited by examiner

*Primary Examiner* — Hoang X Ngo
(74) *Attorney, Agent, or Firm* — Baker Botts L.L.P.

(57) ABSTRACT

A sheet conveying device is configured to start feeding, before a trailing end of a preceding sheet passes a detector, a next sheet following the preceding sheet, based on a calculated sheet length. If the trailing end of the preceding sheet has not been detected by the detector when a counted value reaches a particular count value, the driving of a sheet feed unit configured to feed sheets may be stopped while a conveying unit configured to convey the sheets is continuously being driven. Subsequently, based on the detector detecting the trailing end of the preceding sheet, the driving of the sheet feed unit may be resumed.

8 Claims, 9 Drawing Sheets

SHEET CONVEYING DEVICE AND IMAGE RECORDING APPARATUS

CROSS-REFERENCE TO RELATED APPLICATION

This application claims priority from Japanese Patent Application No. 2018-234768 filed on Dec. 14, 2018, the content of which is incorporated herein by reference in its entirety.

TECHNICAL FIELD

Aspects of the disclosure relate to a sheet conveying device and an image recording apparatus.

BACKGROUND

A known sheet conveying device calculates a sheet length by detecting a leading end of a sheet and a trailing end of the sheet with a detector. Based on the calculated sheet length, the sheet conveying device controls a sheet feed timing such that a distance between sheets that are consecutively fed may be reduced. More specifically, before the trailing end of a preceding sheet passes the detector, a next sheet is fed, thereby reducing the distance between the sheets.

The known sheet conveying device calculates a sheet length every time a sheet or sheets are conveyed. If a difference in the calculated sheet lengths is equal to or greater than a predetermined value, the sheet conveying device stops feeding sheets, thereby preventing or reducing a sheet jam.

SUMMARY

Aspects of the disclosure provide a sheet conveying device and an image recording apparatus including the sheet conveying device configured to start feeding, before a trailing end of a preceding sheet passes a detector, a next sheet following the preceding sheet, based on a calculated sheet length. If the trailing end of the preceding sheet has not been detected by the detector when a counted value reaches a particular count value, the driving of a sheet feed unit configured to feed sheets may be stopped while a conveying unit configured to convey the sheets is continuously being driven. Subsequently, based on the detector detecting the trailing end of the preceding sheet, the driving of the sheet feed unit may be resumed. The sheet conveying device and the image recording apparatus may continue feeding and conveying the sheets while preventing or reducing a sheet jam.

According to an aspect of the disclosure, a sheet conveying device may comprise a sheet feed unit configured to feed sheets, a conveying roller pair disposed downstream of the sheet feed unit in a conveying direction of the sheets, a detector configured to detect the sheets fed by the sheet feed unit, and a controller. The controller may be configured to perform steps comprising calculating a sheet length from a leading end of a first sheet in the conveying direction to a trailing end of the first sheet in the conveying direction, based on the detector detecting the leading end and the trailing end of the first sheet; based on the calculated sheet length, controlling the sheet feed unit to feed, before the detector detects a trailing end of a preceding sheet that is fed after the first sheet, a next sheet following the preceding sheet; based on the calculated sheet length, calculating a first count value; based on the detector detecting a leading end of the preceding sheet, starting counting a value; based on the detector having not detected the trailing end of the preceding sheet when the counted value reaches the first count value, stopping driving the sheet feed unit before a leading end of the next sheet fed by the sheet feed unit reaches the conveying roller pair, while continuously driving the conveying roller pair; and based on the detector detecting the trailing end of the preceding sheet after the stopping driving the sheet feed unit, resuming driving the sheet feed unit.

According to another aspect of the disclosure, an image recording apparatus may comprise the sheet conveying device and an image recording unit disposed downstream of the conveying roller pair in the conveying direction. The image recording unit may be configured to record images on the sheets.

According to aspects of the disclosure, when the sheets are conveyed, a distance between the sheets may be minimized. If an abnormality with respect to a sheet being conveyed should occur, feeding and conveyance of the sheets may be continued while a sheet jam is prevented or reduced.

DETAILED DESCRIPTION

Referring to FIGS. 1-9, illustrative embodiments will be described below.

[Configuration of Image Recording Apparatus]

Figure 1:
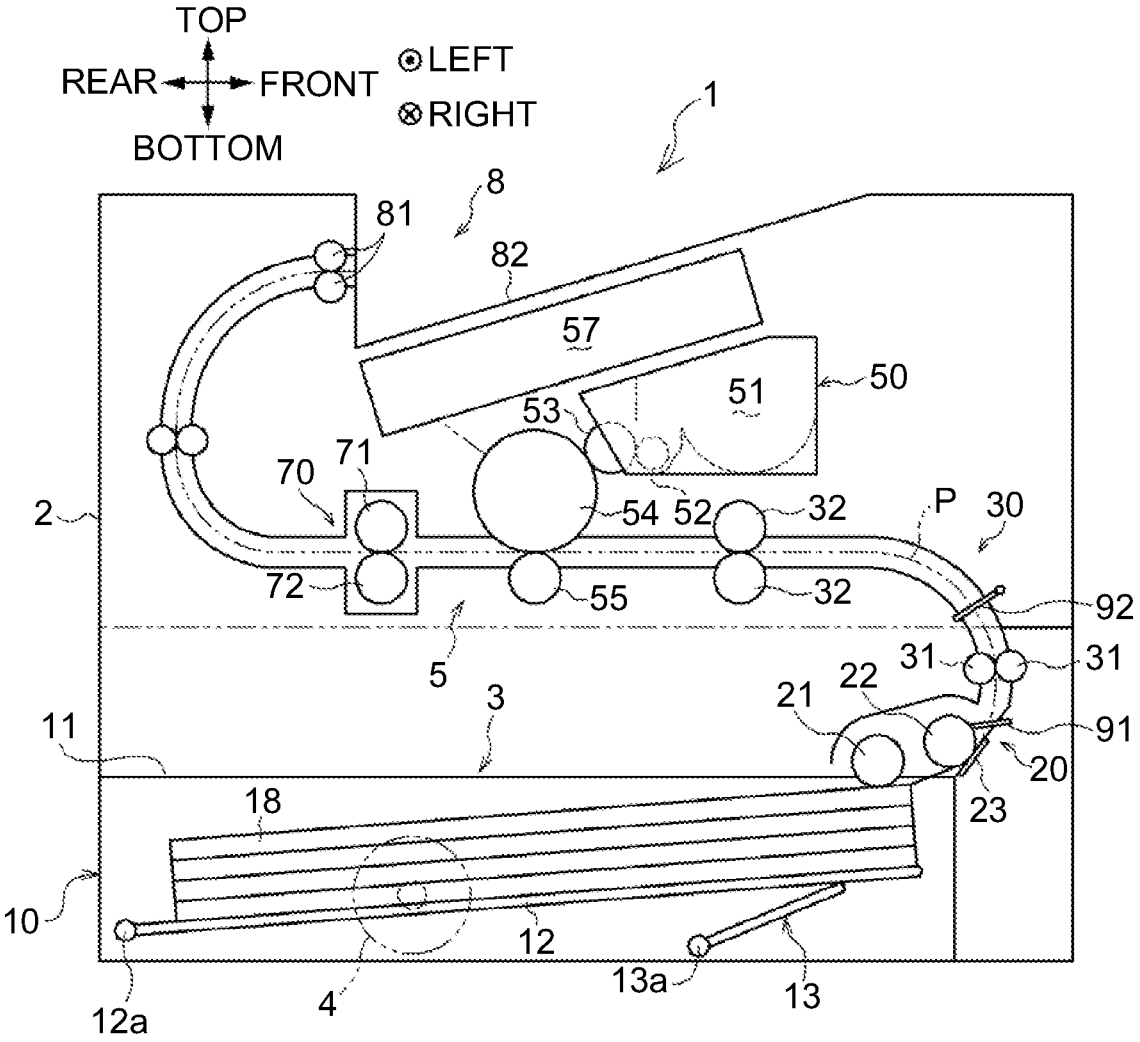
FIG. 1 is a cross-sectional view of an image recording apparatus in an illustrative embodiment according to aspects of the disclosure.

FIG. 1 shows an image recording apparatus 1 according to an illustrative embodiment of the disclosure. In the following description, directional terminology, such as "top/upper," "bottom/lower," "front," "rear," "left," "right" etc., as labeled in the drawings, may be used. With respect to the page of FIG. 1, the right side may be defined as the front of the image recording apparatus 1; the left side may be defined as the rear of the apparatus 1; out of the page may be defined as the left of the apparatus 1; into the page may be defined as the right of the apparatus 1; the upper side may be defined as the top of the apparatus 1; and the lower side may be defined as the bottom of the apparatus 1. Because the disclosed components can be positioned in a number of different orientations, the directional terminology is used for purposes of illustration and is in no way limiting.

The image recording apparatus 1 includes a casing 2, a sheet feed unit 3, a conveying unit 30, an image recording unit 5, a sheet discharge unit 8, and a drive source, e.g., a motor 4. The sheet feed unit 3 includes a sheet tray 10 and a feed mechanism 20. The sheet feed unit 3 is disposed at a lower portion of the image recording apparatus 1. The feed mechanism 20 is configured to feed a sheet supported by the sheet tray 10. The feed mechanism 20 is driven by a drive force from the motor 4.

The casing 2 has a substantially rectangular parallelepiped shape. The casing 2 houses therein various units and components, such as the sheet feed unit 3, the image recording unit 5, and the motor 4. The casing 2 is configured to receive the sheet tray 10 that is slidably movable in the front-rear direction. In the casing 2, a sheet conveying path P is defined. The sheet conveying path P extends from the sheet feed unit 3 to the sheet discharge unit 8 through the image recording unit 5.

The sheet tray 10 includes a frame 11, a support plate 12 configured to support a stack of one or more sheets 18, and a lifter plate 13. The frame 11 has a box shape with an open end facing upward. The support plate 12 is disposed in the frame 11 and is configured to support, from below, a sheet stack accommodated in the frame 11.

The support plate 12 is configured to move between a lower position and a higher position located at a higher position than the lower position. The lifter plate 13 is disposed below the support plate 12 in the frame 11. The lifter plate 13 is configured to lift or raise the support plate 12, by contacting the support plate 12, from the lower position to the higher position.

The support plate 12 is supported by the frame 11 such that the support plate 12 can pivot about a pivot 12*a* disposed at a rear end portion of the support plate 12. The support plate 12 moves between the lower position and the higher position by pivoting about the pivot 12*a*. The lifter plate 13 is supported by the frame 11 such that the lifter plate 13 can pivot about a pivot 13a disposed at a rear end portion of the lifter plate 13. Pivoting of the lifter plate 13 about the pivot 13*a* causes the support plate 12 to move between the lower position and the higher position. The lifter plate 13 is configured to receive a drive force from the motor 4 and to be driven by the drive force.

The feed mechanism 20 includes a feed roller 21, a separation roller 22, and a separation pad 23. The feed mechanism 20 is configured to feed each of the sheets 18 supported by the sheet tray 10.

The feed roller 21 is configured to feed the sheets 18 on the support plate 12 of the sheet tray 10 toward the separation roller 22. The separation roller 22 is disposed downstream of the feed roller 21 in a sheet conveying direction. The separation pad 23 is disposed facing the separation roller 22 and is urged toward the separation roller 22. The feed roller 21 and the separation roller 22 are configured to receive a drive force from the motor 4 and to be driven by the drive force.

The sheets 18 fed by the feed roller 21 toward the separation roller 22 may be separated one by one at a position between the separation roller 22 and the separation pad 23. The separated sheet 18 is then conveyed in the sheet conveying direction along the sheet conveying path P.

The conveying unit 30 is disposed downstream of the feed mechanism 20 in the sheet conveying direction. The conveying unit 30 includes a conveying roller pair 31 and a registration roller pair 32. The conveying unit 30 is configured to convey the sheet 18 fed by the feed mechanism 20 toward the image recording unit 5.

The conveying roller pair 31 is configured to apply a conveying force to the sheet 18. The conveying roller pair 31 is disposed downstream of the separation roller 22 and the separation pad 23 in the sheet conveying direction. The sheet 18 fed by the separation roller 22 toward the conveying roller pair 31 is conveyed toward the registration roller pair 32 along the conveying path P.

The registration roller pair 32 is disposed downstream of the conveying roller pair 31 in the sheet conveying direction. The registration roller pair 32 is configured to temporarily stop the movement of a leading end of the sheet 18, thereby correcting the skew of the sheet 18. After correcting the skew of the sheet 18, the registration roller pair 32 conveys the sheet 18 toward a transfer position in the image recording unit 5 at a predetermined timing.

The image recording unit 5 is disposed downstream of the conveying unit 30 in the sheet conveying direction. The image recording unit 5 is configured to record an image on the sheet 18 conveyed from the conveying unit 30. The image recording unit 5 includes a process cartridge 50 including a photosensitive drum 54, an exposure unit 57, and a fixing unit 70. The process cartridge 50 is configured to transfer an image to a surface of the sheet 18 conveyed from the conveying unit 30. The exposure unit 57 is configured to expose a surface of the photosensitive drum 54 to light. The fixing unit 70 is configured to fix the image transferred by the process cartridge 50 onto the sheet 18.

The process cartridge 50 is disposed in the casing 2 above the sheet feed unit 3. The process cartridge 50 includes a developing chamber 51, a supply roller 52, a developing roller 53, the photosensitive drum 54, and a transfer roller 55.

The exposure unit 57 includes a laser diode, a polygon mirror, a lens, and a reflecting mirror. The exposure unit 57 is configured to emit laser light to the surface of the photosensitive drum 54, based on image data input to the image recording apparatus 1, to selectively expose the surface of the drum 54.

The developer chamber 51 contains developer, e.g., toner. The toner in the developer chamber 51 is conveyed to the supply roller 52 while being agitated by an agitator (not depicted). The supply roller 52 is configured to supply the toner from the developer chamber 51 to the developer roller 53.

The developer roller 53 is disposed in contact with the supply roller 52. The developer roller 53 is configured to carry thereon the toner, which is supplied from the supply roller 52 and is positively charged by a contact member (not depicted). The developer roller 53 is applied with a positive developing bias by a bias application device (not depicted).

The photosensitive drum 54 is disposed adjacent to the developing roller 53. The surface of the photosensitive drum 54 is positively and uniformly charged by a charger (not depicted), and then exposed to the light from the exposure unit 57. On exposed areas of the surface of the photosensitive drum 54 where electric potential is lower than the other areas of the surface of the drum 54, an electrostatic latent image is formed based on the image data. The developing roller 53 supplies the positively charged toner to the surface of the photosensitive drum 54 having the latent image formed thereon, thereby developing the latent image into a visible developer image.

The transfer roller 55 is disposed facing the photosensitive drum 54. The transfer roller 55 is applied with a negative transfer bias by a bias application device. As the sheet 18 is conveyed while being held at a transfer position between the photosensitive drum 54 and the transfer roller 55, which is applied with the transfer bias, the toner image on the surface of the photosensitive drum 54 is transferred to the surface of the sheet 18.

The fixing unit 70 includes a heat roller 71 and a pressure roller 72. The heat roller 71 is configured to be rotated by a drive force from the motor 4 and to be heated with a power from a power source (not depicted). The pressure roller 72 is disposed facing the heat roller 71. The pressure roller 72 is configured to rotate in contact with the heat roller 71, in association with the rotation of the heat roller 71. As the sheet 18 having the developer image transferred thereon is conveyed to the fixing unit 70, the developer image is fixed on the sheet 18 while the sheet 18 is being held between the heat roller 71 and the pressure roller 72 and conveyed by the rollers 71 and 72.

The sheet discharge unit 8 is disposed downstream of the image recording unit 5 in the sheet conveying direction. The sheet discharge unit 8 is configured to discharge the sheet 18 having an image recorded by the image recording unit 5, to an exterior of the casing 2. The sheet discharge unit 8 includes a discharge roller pair 81 and a discharge tray 82. The discharge roller pair 81 is configured to discharge the sheet 18, which is conveyed from the fixing unit 70, to an exterior of the casing 2. The discharge tray 82 is provided at an upper surface of the casing 2. The discharge tray 82 is configured to receive the sheet 18 discharged to an exterior of the casing 2 by the discharge roller pair 81.

Figure 2:
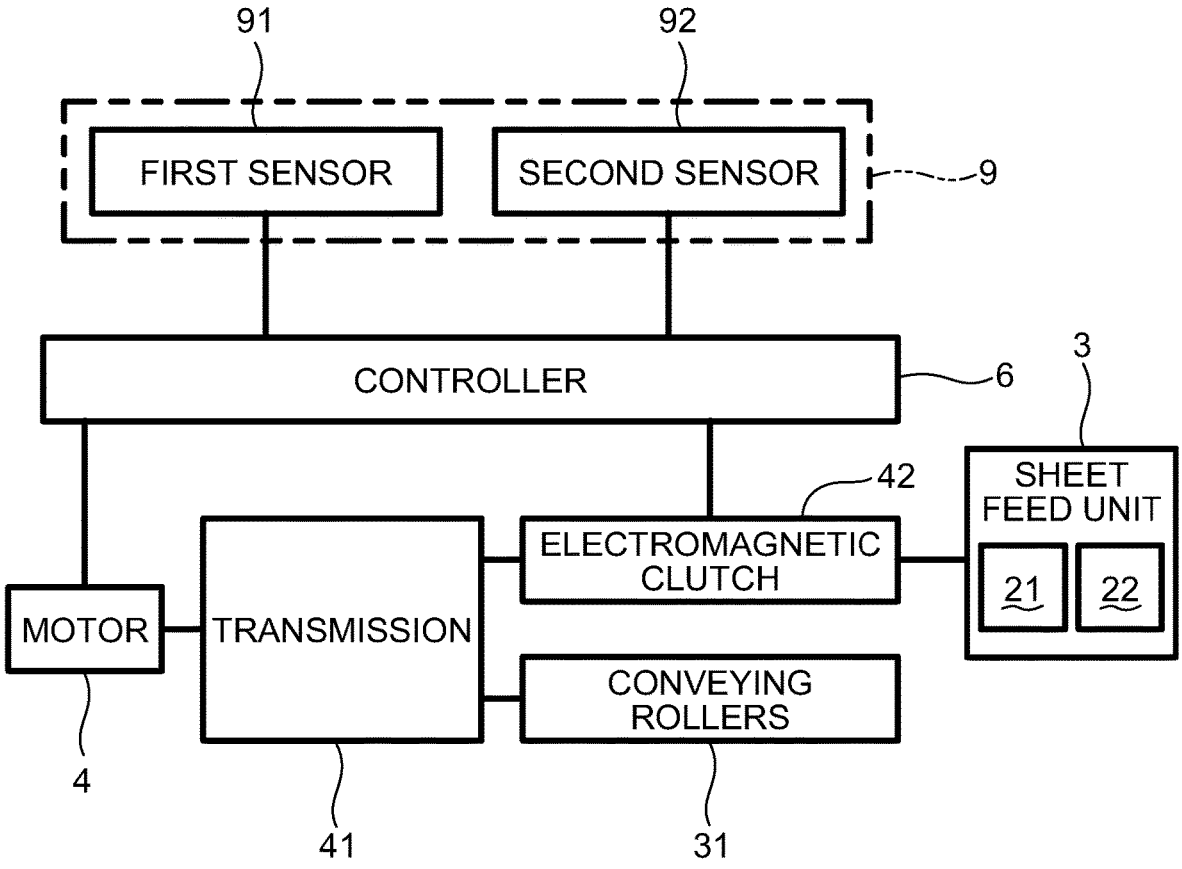
FIG. 2 is a block diagram of a sheet conveying device in an illustrative embodiment according to aspects of the disclosure.

The image recording apparatus 1 includes a detector 9 configured to detect the sheet 18 fed by the sheet feed unit 3. As depicted in FIGS. 1 and 2, the detector 9 includes a first sensor 91 and a second sensor 92. The first sensor 91 is disposed between the separation roller 22 and the conveying roller pair 31. The first sensor 91 is configured to detect the sheet 18 at a position between the separation roller 22 and the conveying roller pair 31. The second sensor 92 is disposed between the conveying roller pair 31 and the registration roller pair 32. The second sensor 92 is configured to detect the sheet 18 at a position downstream of the conveying roller pair 31 in the sheet conveying direction. The second sensor 92 is disposed downstream of the first sensor 91 in the sheet conveying direction.

The first sensor 91 is configured to be turned on when detecting the leading end of the sheet 18 and to be turned off when detecting the trailing end of the sheet 18. The second sensor 92 is configured to be turned on when detecting the leading end of the sheet 18 and to be turned off when detecting the trailing end of the sheet 18.

As depicted in FIG. 2, the image recording apparatus 1 includes a controller 6 to which the first sensor 91 and the second sensor 92 are connected. The image recording apparatus 1 further includes a transmission 41 and an electromagnetic clutch 42 (simply referred to as "the clutch 42" hereinafter). The transmission 41 is configured to transmit a drive force from the motor 4 to the sheet feed unit 3 and the conveying roller pair 31. The clutch 42 is disposed between the transmission 41 and the sheet feed unit 3. The clutch 42 has a transmission mode and an interruption mode and is configured to be selectively changed between the modes. In the transmission mode, the clutch 42 allows the drive force to be transmitted to the sheet feed unit 3 by the transmission 41. In the interruption mode, the clutch 42 prevents the drive force from being transmitted to the sheet feed unit 3 by the transmission 41.

The controller 6 is connected to the motor 4 and the clutch 42, and configured to control driving of the motor 4 and the clutch 42. When the controller 6 turns the clutch 42 on, the clutch 42 is placed in the transmission mode. When the controller 6 turns the clutch 42 off, the clutch 42 is placed in the interruption mode. As the drive force from the motor 4 is transmitted to the sheet feed unit 3 by the transmission 41, the feed roller 21 and the separation roller 22 are driven, and feed a sheet 18. As the drive force from the motor 4 is not transmitted to the sheet feed unit 3 by the transmission 41, the feed roller 21 and the separation roller 22 are not driven, and stop feeding a sheet 18.

The image recording apparatus 1 includes a sheet conveying device that includes the sheet feed unit 3, the detector 9, the controller 6, the motor 4, the transmission 41, and the clutch 42.

[First Illustrative Embodiment of Sheet Conveying Control]

Controls for feeding and conveying sheets 18 by the sheet conveying device of the image recording apparatus 1 will now be described. When the sheet conveying device feeds and conveys the sheets 18, the following sheet conveying control is performed to minimize a distance between the sheets 18.

Figure 3:
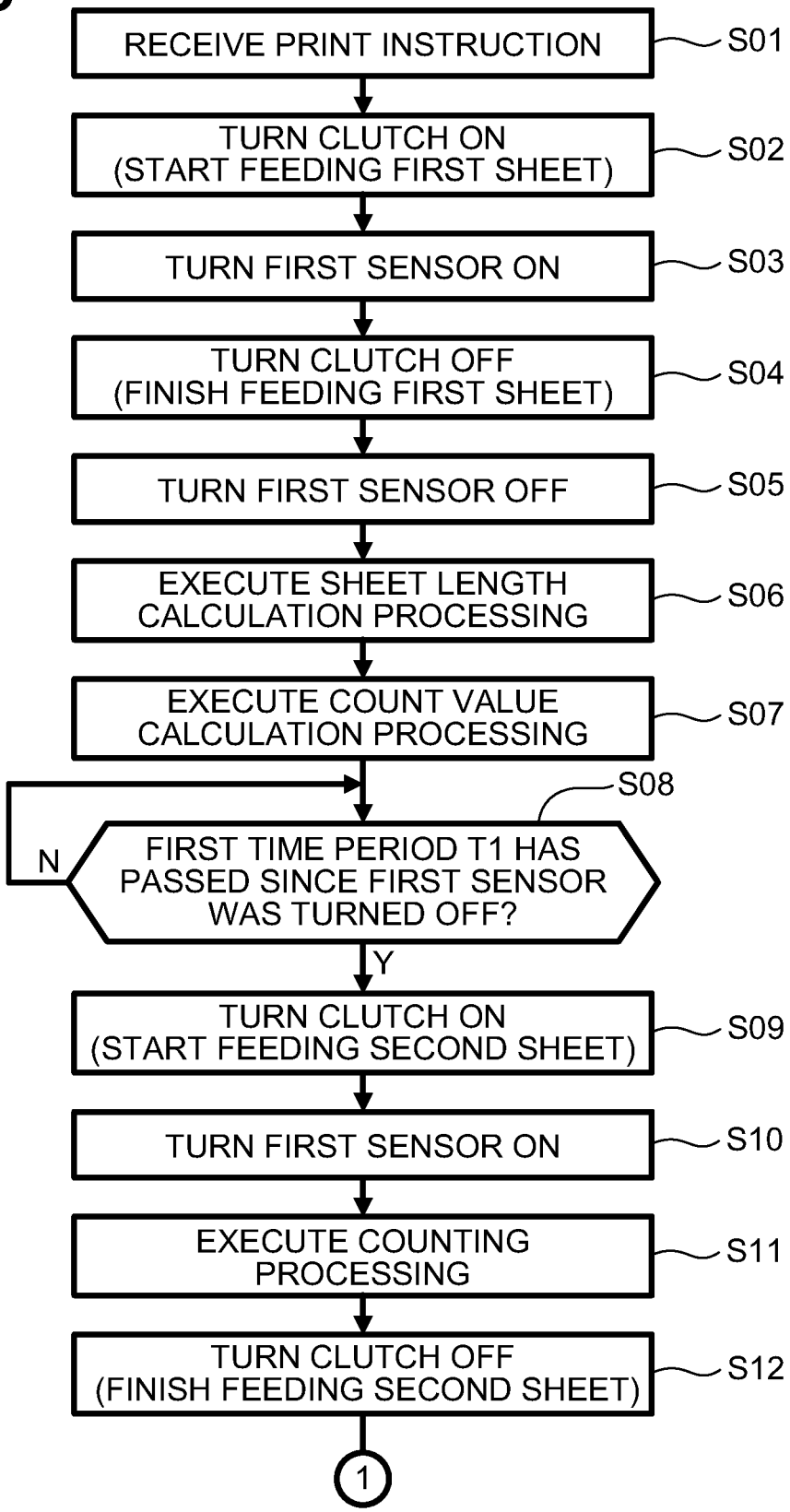
FIG. 3 is a flowchart illustrating steps S01-S12 of a sheet conveying control in a first illustrative embodiment according to aspects of the disclosure.
Figure 5:
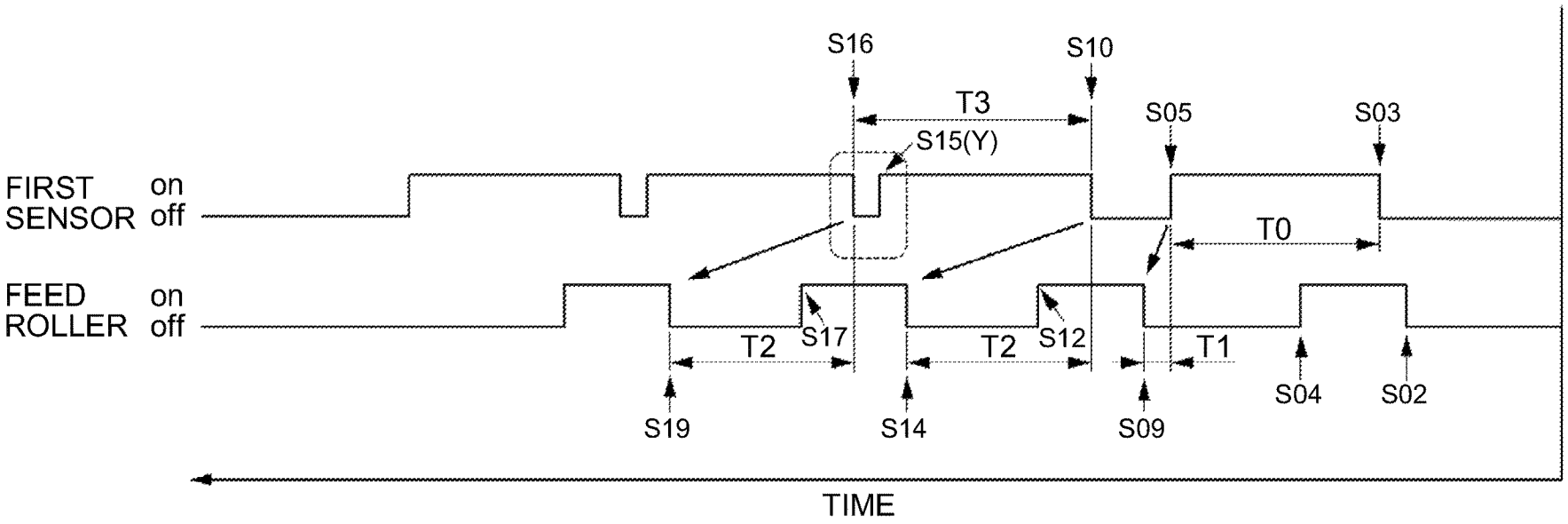
FIG. 5 is a timing chart of the sheet conveying control in the first illustrative embodiment, illustrating that a first sensor is turned off before a counted value reaches a third time period T3.

As depicted in FIGS. 3 and 5, based on receiving a print instruction for printing a print job on the sheets 18 (step S01), the controller 6 of the image recording apparatus 1 causes the clutch 42 to turn on. As the clutch 42 is turned on, the drive force from the motor 4 is transmitted to the sheet feed unit 3. This causes the feed roller 21 and the separation roller 22 to be driven, thereby starting to feed a topmost sheet 18 (e.g., a first sheet) (step S02).

As a leading end of the fed first sheet 18 reaches a detecting position of the first sensor 91 where the first sensor 91 detects a sheet 18, the first sensor 91 is turned on. The leading end of the first sheet 18 is thus detected by the first sensor 91 (step S03). As the leading end of the first sheet 18 reaches the conveying roller pair 31 and the first sheet 18 starts to be conveyed by the conveying roller pair 31, the controller 6 causes the clutch 42 to turn off. As the clutch 42 is turned off, the drive force from the motor 4 is not transmitted to the sheet feed unit 3, resulting in the stoppage of the feed roller 21 and the separation roller 22. The feeding of the first sheet 18 thus ends (step S04).

Subsequently, as a trailing end of the first sheet 18 being conveyed by the conveying roller pair 31 reaches the detecting position of the first sensor 91, the first sensor 91 is turned off. The trailing end of the first sheet 18 is thus detected by the first sensor 91 (step S05). As the trailing end of the first sheet 18 is detected by the first sensor 91, the controller 6 executes sheet length calculation processing, in which a length of the sheet 18 in the sheet conveying direction is calculated, based on the first sensor 91 detecting the leading end and the trailing end of the first sheet 18 (step S06).

In one example, the controller 6 calculates the length of the sheet 18 based on a time period T0 and a conveying speed of the sheet 18. The time period T0 is a period of time from when the first sensor 91 detects the leading end of the sheet 18 until the first sensor 91 detects the trailing end of the sheet 18. In this case, for example, the controller 6 starts counting the time from when the first sensor 91 detects the leading end of the sheet 18, and finishes counting the time at when the first sensor 91 detects the trailing end of the sheet 18. By counting the time from when the first sensor 91 detects the leading end of the sheet 18 until the first sensor 91 detects the trailing end of the sheet 18, the controller 6 measures the time period T0.

In some embodiments, a length of the sheet 18 may be calculated in the sheet length calculation processing at step S06, based on, for example, a rotation amount of the conveying roller pair 31 counted by a rotary encoder from when the first sensor 91 detects the leading end of the sheet 18 until the first sensor 91 detects the trailing end of the sheet 18.

Based on the length of the sheet 18 calculated in the sheet length calculation processing at step S06, the controller 6 executes count value calculation processing (step S07) in which a second time period T2, a third time period T3, and a fourth time period T4 are calculated. The count value calculation processing will be described in detail below. The third time period T3 is an example of a "first count value" as claimed. The fourth time period T4 is an example of a "second count value" as claimed.

The controller 6 determines whether a first time period T1 has passed since the first sensor 91 has been turned off at step S05 (step S08). The first time period T1 is predetermined and is set to provide a distance between the first sheet 18 and a next second sheet 18. The controller 6 repeats step S08 until the first time period T1 passes (step S08: N wherein "N" represents "NO" and this representation may be used hereinafter and in the drawings). If the controller 6 determines that the first time period T1 has passed (step S08: Y wherein "Y" represents "YES" and this representation may also be used hereinafter and in the drawings), the controller 6 causes the clutch 42 to turn on (step S09). As the clutch 42 is turned on, the drive force from the motor 4 is transmitted to the sheet feed unit 3. This causes the feed roller 21 and the separation roller 22 to be driven, thereby starting to feed a topmost sheet 18 (e.g., a second sheet). The second sheet 18 is an example of "a preceding sheet" as claimed.

As a leading end of the fed second sheet 18 reaches the detecting position of the first sensor 91, the first sensor 91 is turned on. The leading end of the second sheet 18 is thus detected by the first sensor 91 (step S10).

As the first sensor 91 detects the leading end of the second sheet 18, the controller 6 executes counting processing (step S11) in which the controller 6 counts the time elapsed from when the first sensor 91 detects the leading end of the second sheet 18. The counting processing at step S11 is executed based on the first sensor 91 detecting a leading end of a preceding sheet (e.g., the second sheet 18).

As the leading end of the second sheet 18 reaches the conveying roller pair 31 and the second sheet 18 starts to be conveyed by the conveying roller pair 31, the controller 6 causes the clutch 42 to turn off. As the clutch 42 is turned off, the drive force from the motor 4 is not transmitted to the sheet feed unit 3, resulting in the stoppage of the feed roller 21 and the separation roller 22. The feeding of the second sheet 18 thus ends (step S12).

Figure 4:
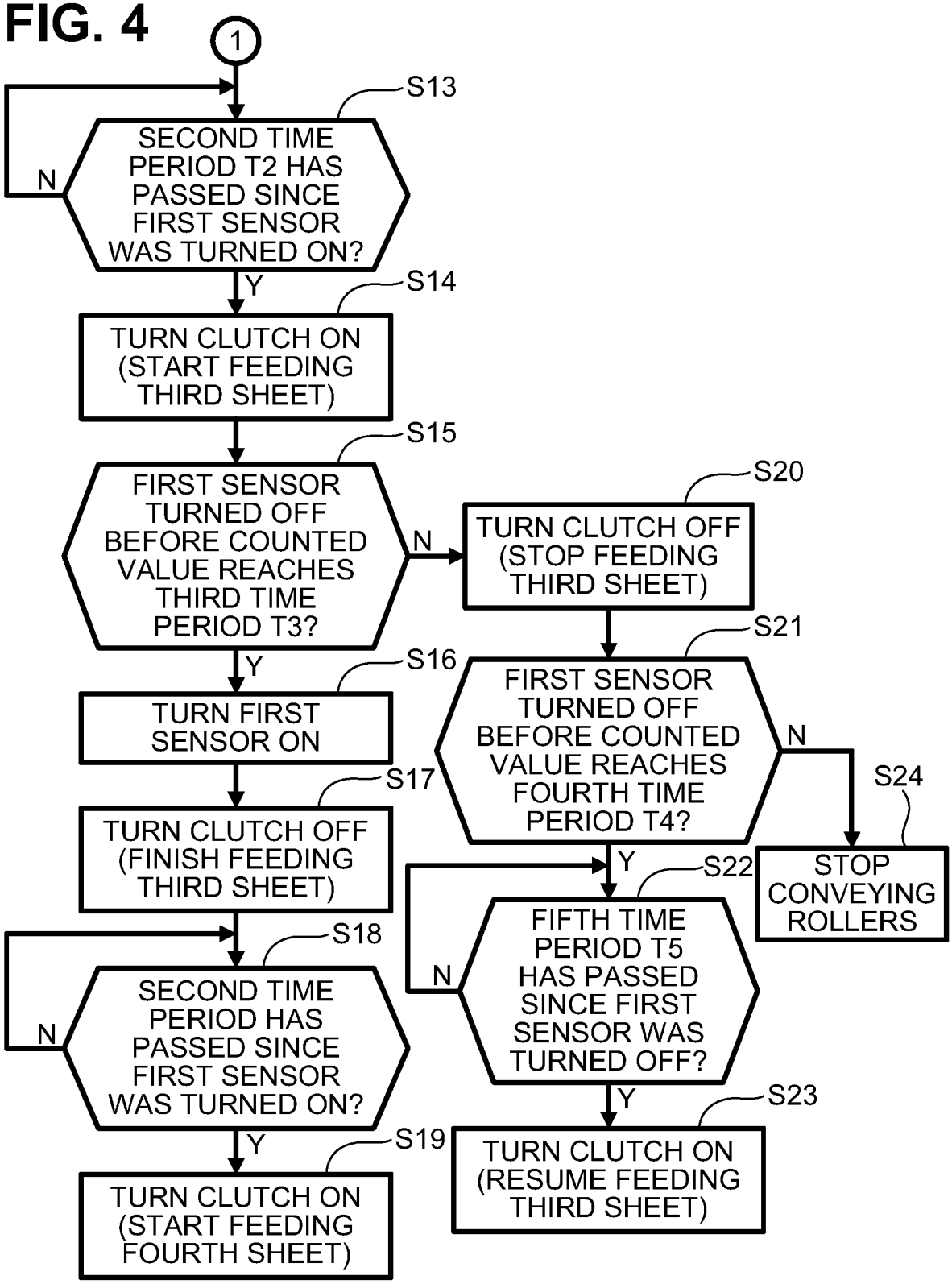
FIG. 4 is a flowchart illustrating steps S13-S24 of the sheet conveying control in the first illustrative embodiment.

As depicted in FIGS. 4 and 5, the controller 6 determines whether the second time period T2 has passed since the first sensor 91 detected the leading end of the second sheet 18 and has been turned on at step S10 (step S13). The controller 6 repeats step S13 (step S13: N) until the second time period T2 passes. If the controller 6 determines that the second time period T2 has passed (step S13: Y), the controller 6 causes the clutch 42 to turn on (step S14). As the clutch 42 is turned on, the drive force from the motor 4 is transmitted to the sheet feed unit 3. This causes the feed roller 21 and the separation roller 22 to be driven, thereby starting to feed a topmost sheet 18 (e.g., a third sheet). The third sheet 18 is an example of "a next sheet following the preceding sheet" as claimed.

The second time period T2 is set to a time period that allows a next sheet 18 (e.g., the third sheet 18) to be started to be fed before the trailing end of a preceding sheet 18 (e.g., the second sheet 18) is detected by the first sensor 91. In other words, the controller 6 executes sheet feed timing control at step S14, based on the length of the sheet 18 calculated in the sheet length calculation processing, to control a sheet feed timing of the third sheet 18 (e.g., a next sheet). In one example, the controller 6 controls the sheet feed unit 3 to feed the third sheet 18 before the trailing end of the second sheet 18 (e.g., a preceding sheet) is detected by the first sensor 91.

The image recording apparatus 1 is configured to start feeding the third sheet 18 before the trailing end of the second sheet 18 is detected by the first sensor 91. This configuration reduces a distance between the second sheet 18 and the third sheet 18, as compared with a configuration in which the third sheet 18 is fed after the trailing end of the second sheet 18 is detected by the first sensor 91.

Subsequent to step S14 at which the controller 6 causes the clutch 42 to turn on, the controller 6 determines whether the first sensor 91, which detected the leading end of the second sheet 18 and has been turned on, is turned off before the value counted in the counting processing at step S11 reaches the third time period T3 (step S15). The third time period T3 is set to a time period enough for the first sensor 91 to detect the trailing end of the second sheet 18 after detecting the leading end of the second sheet 18. In one example, the third time period T3 is set to a time period corresponding to the length of the sheet 18 calculated at the sheet length calculation processing plus a predetermined extra time.

If the controller 6 determines that the first sensor 91 is turned off before the counted value reaches the third time period T3, e.g., the first sensor 91 detects the trailing end of the second sheet 18 before the third time period T3 passes (step S15: Y), the first sensor 91 is then turned on as a leading end of the third sheet 18 reaches the first sensor 91. The leading end of the third sheet 18 is thus detected by the first sensor 91 (step S16). In the illustrative embodiment, the third time period T3 is set to a time period until the leading end of the third sheet 18 will reach the first sensor 91.

As the leading end of the third sheet 18 reaches the conveying roller pair 31 and the third sheet 18 starts to be conveyed by the conveying roller pair 31, the controller 6 causes the clutch 42 to turn off (step S17). As the clutch 42 is turned off, the drive force from the motor 4 is not transmitted to the sheet feed unit 3, resulting in the stoppage of the feed roller 21 and the separation roller 22. The feeding of the third sheet 18 thus ends.

The controller 6 determines whether the second time period T2 has passed since the leading end of the third sheet 18 was detected by the first sensor 91 and the first sensor 91 has been turned on at step S16 (step S18). The controller 6 repeats step S18 (step S18: N) until the second time period T2 passes. If the controller 6 determines that the second time period T2 has passed (step S18: Y), the controller 6 causes the clutch 42 to turn on (step S19). As the clutch 42 is turned on, the drive force from the motor 4 is transmitted to the sheet feed unit 3. This causes the feed roller 21 and the separation roller 22 to be driven, thereby starting to feed a topmost sheet 18 (e.g., a fourth sheet).

In this situation, the third sheet 18 is a preceding sheet, and the fourth sheet 18 is a next sheet following the preceding sheet. After causing the clutch 42 to turn on at step S19, the controller 6 executes processing similar to step S15 until the printing of the print job is finished.

Figure 6:
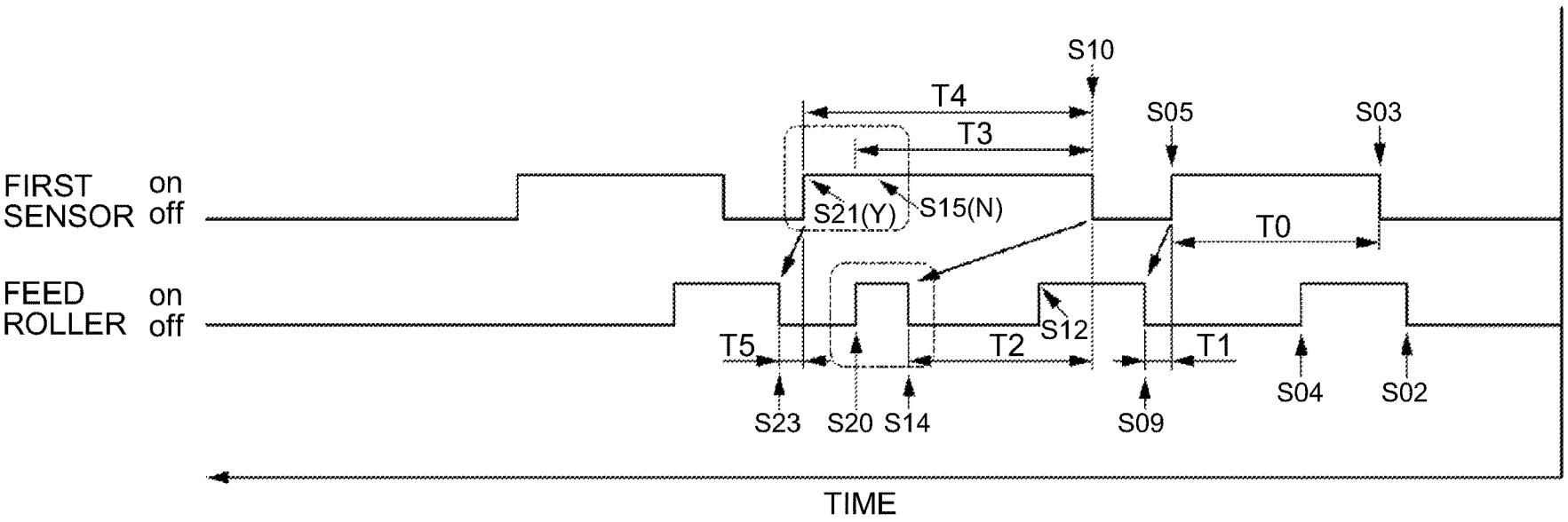
FIG. 6 is a timing chart of the sheet conveying control in the first illustrative embodiment, illustrating that the first sensor is not turned off before a counted value reaches the third time period T3 but is turned off before the counted value reaches a fourth time period T4.

As depicted in FIGS. 4 and 6, the controller 6 determines at step S15 that the first sensor 91, which detected the leading end of the second sheet 18 and has been turned on, is not turned off before the counted value reaches the third time period T3 (S15: N), the controller 6 causes the clutch 42 to turn off, and stops feeding the third sheet 18 (step S20). If the first sensor 91 has not detected the trailing end of the second sheet 18 when the time started to be counted in the counting processing at S11 reaches the third time period T3 which is calculated at the count value calculation processing (at step S07), the controller 6 executes, after the third sheet 18 is started to be fed, sheet feed stop processing in which feeding of the third sheet 18 is stopped.

If the first sensor 91, which detected the leading end of the second sheet 18, is not turned off when the counted value reaches the third time period T3, the trailing end of the second sheet 18 has not reached the first sensor 91 when the counted value reaches the third time period T3. This situation may be considered as an occurrence of an abnormality, e.g., a sheet length difference between the first sheet and the second sheet (the length of the second sheet is longer than the length of the first sheet calculated at step S06). If the third sheet 18 continued to be fed in such situation, the leading end of the third sheet 18 might reach the first sensor 91 before the trailing end of the second sheet 18 reached the first sensor 91. This may cause a sheet jam in the sheet conveying device. To prevent the sheet jam, the controller 6 causes the sheet feed unit 3 to stop feeding the third sheet 18 that is in the middle of being fed.

In this state, the leading end of the third sheet 18, which is stopped by the sheet feed unit 3 in the middle of being fed, has not reached the conveying roller pair 31. In other words, the controller 6 causes the sheet feed unit 3 to stop feeding the third sheet 18 before the leading end of the third sheet 18 reaches the conveying roller pair 31. This configuration may prevent or reduce occurrences of a sheet jam in the sheet conveying device because the third sheet 18 whose feeding is stopped, may not be conveyed by the conveying roller pair 31.

In the sheet feed stop processing, the controller 6 causes the conveying roller pair 31 to be continuously driven while stopping feeding the third sheet 18. This may continue conveyance of the second sheet 18, which is currently being conveyed by conveying roller pair 31.

The controller 6 causes the clutch 42 to turn off when executing sheet feed stop processing in which feeding of the third sheet 18 is stopped. In other words, the clutch 42 is placed in the interruption mode to stop driving the sheet feed unit 3. The clutch 42, which is disposed between the transmission 41 and the sheet feed unit 3, may be switched to the interruption mode, thereby stopping the driving of the sheet feed unit 3. While one motor 4 drives the sheet feed unit 3 and the conveying roller pair 31, the driving of the sheet feed unit 3 may be stopped.

As the controller 6 executes the sheet feed stop processing and the clutch 42 is switched to the interruption mode, the feed roller 21 and the separation roller 22 of the sheet feed unit 3 are disconnected from the motor 4 and the transmission 41, and may rotate freely. This may prevent or reduce the application of significant resistance to the second sheet 18 whose trailing end may be in the sheet feed unit 3 when the second sheet 18 is conveyed by the conveying roller pair 31 after the sheet feed stop processing.

After stopping feeding the third sheet 18 at step S20, the controller 6 determines whether the first sensor 91, which detected the leading end of the second sheet 18 and has been turned on, is turned off before the counted value reaches the fourth time period T4 (step S21). The fourth time period T4 is set to a time period equal to a sum of the third time period T3 and a predetermined time. The fourth time period T4 is longer than the third time period T3.

If the controller 6 determines that the first sensor 91 is turned off before the counted value reaches to the fourth time period T4 (step S21: Y), the controller 6 then determines whether a fifth time period T5 has passed since the first sensor 91 was turned off (step S22). The fifth time period T5 is predetermined and is set to provide some time before the clutch 42 is turned on after the first sensor 91 is turned off The controller 6 repeats step S22 (step S22: N) until the fifth time period T5 passes. If the controller 6 determines that the fifth time period T5 has passed (step S22: Y), the controller 6 causes the clutch 42 to turn on (step S23). As the clutch 42 is turned on, the drive force from the motor 4 is transmitted to the sheet feed unit 3. This causes the feed roller 21 and the separation roller 22 to be driven, thereby starting feeding the third sheet 18 again. In other words, based on the first sensor 91 detecting the trailing end of the preceding second sheet 18 after the sheet feed stop processing at step S20, the controller 6 executes resumption processing in which the controller 6 resumes the driving of the sheet feed unit 3.

If the controller 6 determines, at step S21, that the first sensor 91 is turned off before the counted value reaches the fourth time period T4 after stopping feeding the third sheet 18 at step S20, the controller 6 starts feeding the third sheet 18 again. If an abnormality with respect to a sheet 18 being conveyed should occur, feeding and conveyance of sheets 18 may be continued while a sheet jam is prevented or reduced.

Figure 7:
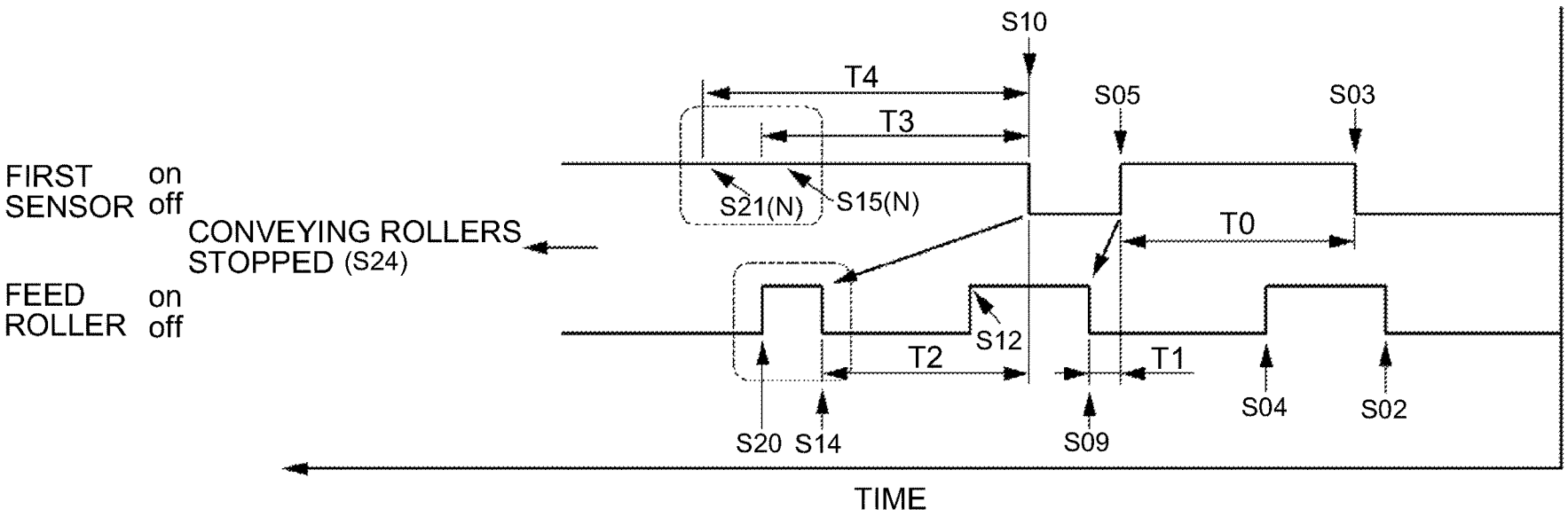
FIG. 7 is a timing chart of the sheet conveying control in the first illustrative embodiment, illustrating that the first sensor is not turned off before a counted value reaches the third time period T3 or is not turned off before the counted value reaches the fourth time period T4.

As depicted in FIGS. 4 and 7, the controller 6 determines that the first sensor 91 is not turned off before the counted value reaches the fourth time period T4 (step S21: N), the controller 6 controls the driving of the motor 4 and stops driving the conveying roller pair 31 (step S24). If the first sensor 91 has not detected the trailing end of the preceding second sheet 18 when the value started to be counted in the counting processing at S11 reaches the fourth time period T4, the controller 6 executes, after the sheet feed stop processing at step S20, conveyance stop processing in which the driving of the conveying roller pair 31 is stopped.

If the trailing end of the second sheet 18 has not been detected when the counted value reaches the fourth time period T4, which is longer than the third time period T3, an extremely long sheet 18 may be conveyed or a sheet 18 being conveyed may be jammed. Conveyance of the sheet 18 may be stopped, by stopping the driving of the conveying roller pair 31, to prevent such situation from being continued.

The controller 6 may preferably be configured to execute the sheet feed stop processing at step S20 before the leading end of the third sheet 18 reaches the detecting position of the first sensor 91. In other words, if the first sensor 91 has not detected the trailing end of the second sheet 18 when the value counted in the counting processing at S11 reaches the third time period T3, the controller 6 may preferably stop driving the sheet feed unit 3 in the sheet feed stop processing, before the leading end of the third sheet 18 fed by the sheet feed unit 3 reaches the detecting position of the first sensor 91. In this configuration, the controller 6 may continuously drive the conveying roller pair 31 while stopping driving the sheet feed unit 3.

The controller 6 may execute the sheet feed stop processing before the leading end of the third sheet 18 reaches the detecting position of the first sensor 91. If the first sensor 91 has not detected the trailing end of the second sheet 18 when the counted value reaches the third time period T3, the driving of the sheet feed unit 3 may be stopped before the leading end of the third sheet 18 reaches the detecting position of the first sensor 91. Subsequently, based on the first sensor 91 detecting the trailing end of the second sheet 18, the controller 6 may resume feeding of the third sheet 18.

The sheet feed unit 3 includes the support plate 12, the feed roller 21, and the separation roller 22. In the sheet feed unit 3, the support plate 12 is driven, pressing a stack of the sheets 18 against the feed roller 21. Thereafter, the feed roller 21 may feed a sheet 18 from the sheet stack. Time lag is present between the time when an instruction to drive the support plate 12 is output and the time when the feed roller 21 feeds a sheet 18. A certain distance is required between the feed roller 21 and the detector 9.

If a next sheet 18 is started to be fed after the detector 9 detects a trailing end of a preceding sheet 18, a distance between a preceding sheet 18 and a next sheet 18 is relatively long. Since the controller 6 executes the sheet feed timing control, the distance between the preceding sheet 18 and the next sheet 18 may be effectively reduced.

[Second Illustrative Embodiment of Sheet Conveying Control]

Sheet conveying control according to a second illustrative embodiment will now be described.

In a sheet conveying control in the second illustrative embodiment, a resumption processing, which is executed after the sheet feed stop processing at step S20, is different from the resumption processing in the sheet conveying control in the first illustrative embodiment. In the sheet conveying control in the second illustrative embodiment, a third time period T3 is set to a time period that allows the leading end of the third sheet 18 to reach a position immediately before a nip point of the conveying roller pair 31, e.g., a position between the first sensor 91 and the nip point of the conveying roller pair 31. Steps S01-S20 in the second illustrative embodiment are similar to those of the first illustrative embodiment, so that detailed description thereof with respect to the second illustrative embodiment is omitted herein.

Figure 8:
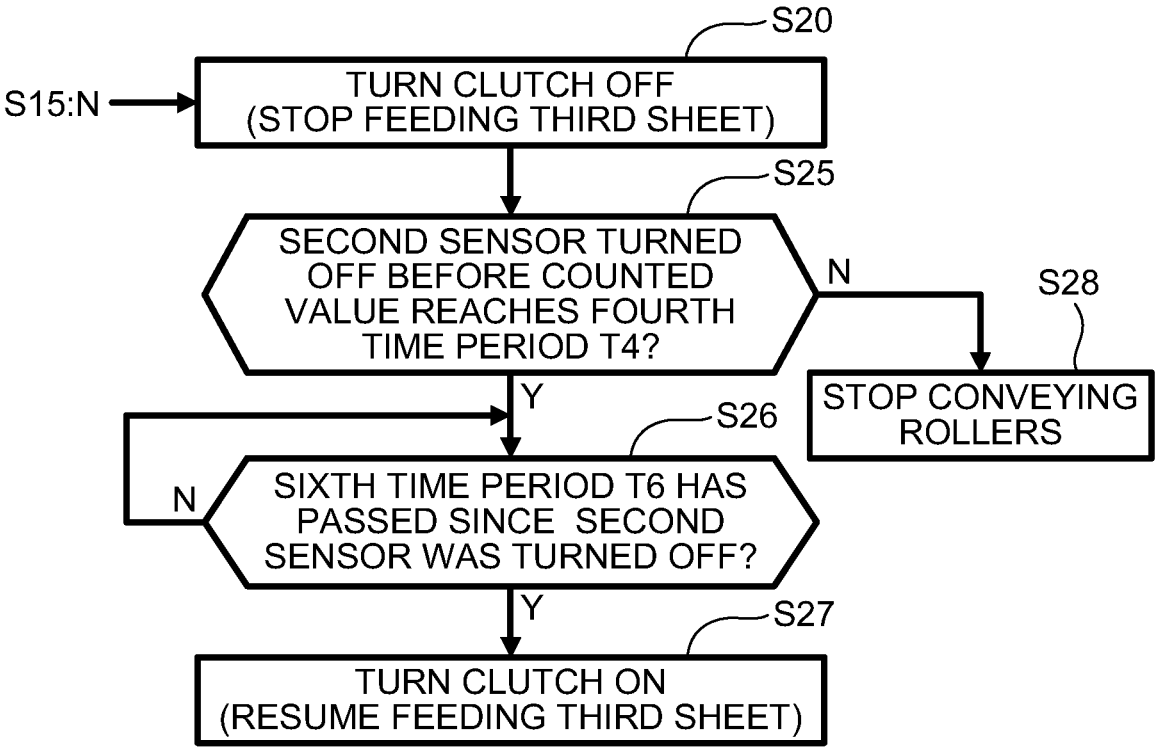
FIG. 8 is a flowchart illustrating a sheet feeding control in a second illustrative embodiment according to aspects of the disclosure.
Figure 9:
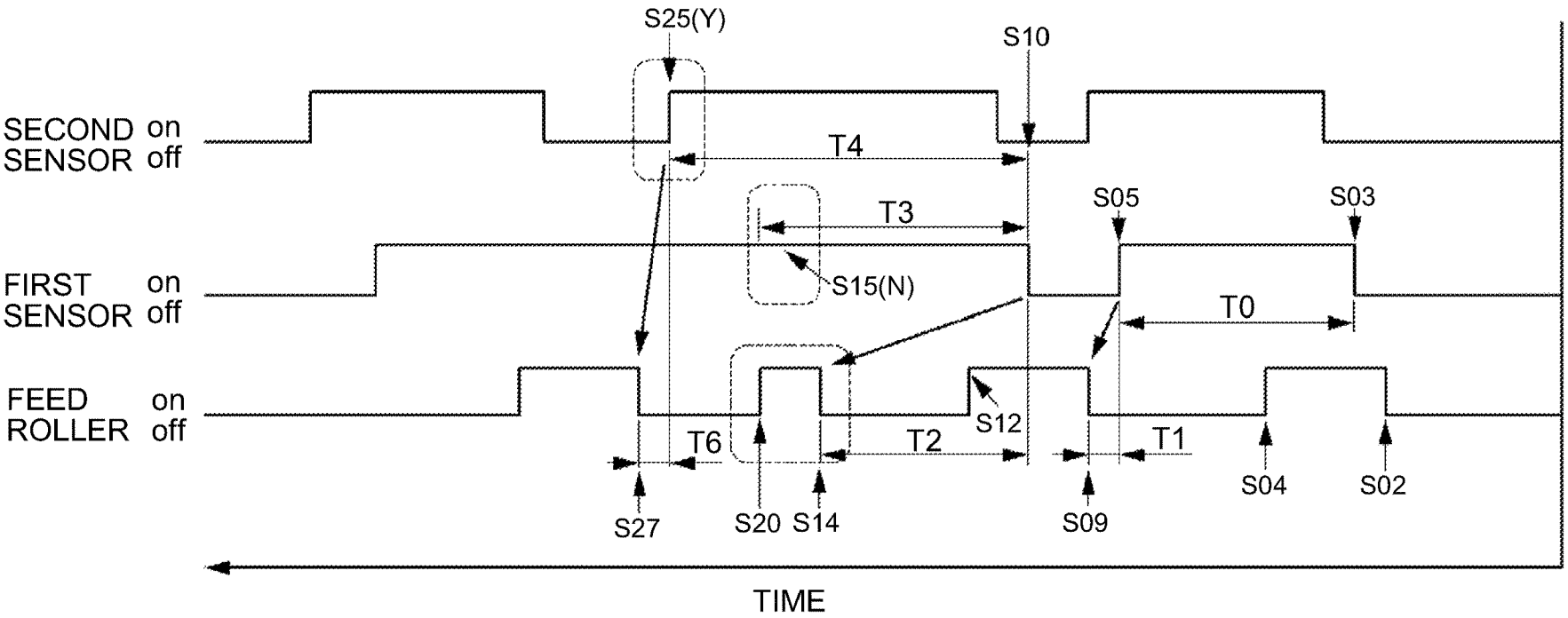
FIG. 9 is a timing chart of the sheet conveying control in the second illustrative embodiment, illustrating that the first sensor is not turned off before a counted value reaches a third time period T3.

As depicted in FIGS. 8 and 9, if the controller 6 determines at step S15 that the first sensor 91 is not turned off before the counted value reaches the third time period T3 (S15: N), the controller 6 stops feeding the third sheet 18 at step S20. Subsequently, the controller 6 determines whether the second sensor 92 is turned off before the counted value reaches the fourth time period T4 (step S25).

If the controller 6 determines that the second sensor 92 is turned off before the counted value reaches the fourth time period T4, e.g., the second sensor 92 detects the trailing end of the second sheet 18 (step S25: Y), the controller 6 determines whether a sixth time period T6 has passed since the second sensor 92 was turned off (step S26). The sixth time period T6 is predetermined and is set to provide some time before the clutch 42 is turned on after the second sensor 92 is turned off The controller 6 repeats step S26 (step S26: N) until the sixth time period T6 passes. If the controller 6 determines that the sixth time period T6 has passed (step S26: Y), the controller 6 causes the clutch 42 to turn on (step S27). As the clutch 42 is turned on, the drive force from the motor 4 is transmitted to the sheet feed unit 3. This causes the feed roller 21 and the separation roller 22 to be driven, thereby starting feeding the third sheet 18 again. In other words, the controller 6 executes, after the sheet feed stop processing at step S20, the resumption processing in which the driving of the sheet feed unit 3 is resumed based on the second sensor 92 detecting the trailing end of the preceding second sheet 18.

In a case where the third time period T3 is set to a time period that allows the leading end of the third sheet 18 to reach a position between the first sensor 91 and the nip point of the conveying roller pair 31, the leading end of the third sheet 18 may reach the detecting position of the first sensor 91 before the trailing end of the second sheet 18 reaches the detecting position of the first sensor 91. This may cause the first sensor 91 to fail to detect the trailing end of the second sheet 18. However, in the second illustrative embodiment, the driving of the sheet feed unit 3 is resumed based on the detection of the trailing end of the second sheet 18 by the second sensor 92, which is disposed downstream of the first sensor 91 in the sheet conveying direction. If the first sensor 91 should fail to detect the trailing end of the second sheet 18, the driving of the sheet feed unit 3 may be resumed based on the second sensor 92 detecting the trailing end of the second sheet 18.

If the controller 6 determines at step S25 that the second sensor 92 is not turned off before the counted value reaches the fourth time period T4 (step S25: N), the controller 6 controls the driving of the motor 4 and stops driving the conveying roller pair 31 (step S28). If the second sensor 92 has not detected the trailing end of the preceding second sheet 18 when the value started to be counted in the counting processing at S11 reaches the fourth time period T4, the controller 6 executes, after the sheet feed stop processing at step S20, conveyance stop processing in which driving of the conveying roller pair 31 is stopped.

In the illustrative embodiments, the controller 6 counts time for the first to sixth time period T1-T6. In another embodiment, the controller 6 may count a physical amount, e.g., a rotation amount of the conveying roller pair 31 detected by a rotary encoder, for the first to sixth time period T1-T6.

The illustrative embodiments are described in conjunction with a sheet conveying device configured to convey sheets 18 supported by the sheet tray 10 in the casing 2. Aspects of disclosure may be applied to a sheet conveying device configured to convey sheets 18 supported by a support tray, e.g., a multi-purpose tray, disposed at a front surface of the casing 2.

What is claimed is:

1. A sheet conveying device, comprising:

a sheet feed unit configured to feed sheets;

a conveying roller pair disposed downstream of the sheet feed unit in a conveying direction of the sheets;

a detector configured to detect the sheets fed by the sheet feed unit; and a controller;

wherein the controller is configured to perform steps comprising:

calculating a sheet length from a leading end of a first sheet in the conveying direction to a trailing end of the first sheet in the conveying direction, based on the detector detecting the leading end and the trailing end of the first sheet;

based on the calculated sheet length, controlling the sheet feed unit to feed, before the detector detects a trailing end of a preceding sheet that is fed after the first sheet, a next sheet following the preceding sheet;

based on the calculated sheet length, calculating a first count value;

based on the detector detecting a leading end of the preceding sheet, starting counting a value;

based on the detector having not detected the trailing end of the preceding sheet when the counted value reaches the first count value, stopping driving the sheet feed unit before a leading end of the next sheet fed by the sheet feed unit reaches the conveying roller pair, while continuously driving the conveying roller pair; and based on the detector detecting the trailing end of the preceding sheet after the stopping driving the sheet feed unit, resuming driving the sheet feed unit.

2. The sheet conveying device according to claim 1, wherein the detector includes a first sensor configured to detect the sheets at a position between the sheet feed unit and the conveying roller pair in the conveying direction, wherein the stopping driving the sheet feed unit includes, based on the first sensor having not detected the trailing end of the preceding sheet when the counted value reaches the first count value, stopping driving the sheet feed unit before the leading end of the next sheet fed by the sheet feed unit reaches a detecting position of the first sensor, while continuously driving the conveying roller pair.

3. The sheet conveying device according to claim 1, wherein the detector includes a first sensor configured to detect the sheets at a position between the sheet feed unit and the conveying roller pair in the conveying direction, and a second sensor configured to detect the sheets at a position downstream of the conveying roller pair in the conveying direction, and wherein the resuming driving the sheet feed unit includes resuming driving the sheet feed unit based on the second sensor detecting the trailing end of the preceding sheet.

4. The sheet conveying device according to claim 1, further comprising:

a drive source;

a transmission configured to transmit drive force from the drive source to the sheet feed unit and the conveying roller pair; and an electromagnetic clutch having a transmission mode in which the drive force is allowed to be transmitted by the transmission to the sheet feed unit, and an interruption mode in which the drive force is prevented from being transmitted by the transmission to the sheet feed unit, the electromagnetic clutch configured to be selectively switched between the transmission mode and the interruption mode;

wherein the stopping driving the sheet feed unit includes stopping driving the sheet feed unit by switching the electromagnetic clutch to the interruption mode.

5. The sheet conveying device according to claim 4, wherein the sheet feed unit includes a feed roller configured to feed the sheets, and a separation roller configured to convey the sheets toward the conveying roller pair by separating the sheets from one another; and wherein based on the electromagnetic clutch switched to the interruption mode, the feed roller and the separation roller rotate freely.

6. The sheet conveying device according to claim 1, wherein the sheet feed unit includes:

a support plate configured to support the sheets;

a feed roller configured to feed the sheets on the support plate; and a separation roller configured to convey the sheets toward the conveying roller pair by separating the sheets from one another.

7. The sheet conveying device according to claim 1, wherein the controller is further configured to perform:

based on the detector having not detected the trailing end of the preceding sheet when the counted value reaches a second count value, stopping driving the conveying roller pair after the stopping driving the sheet feed unit.

8. An image recording apparatus, comprising:

the sheet conveying device according to claim 1; and an image recording unit disposed downstream of the conveying roller pair in the conveying direction, the image recording unit configured to record images on the sheets.

* * * * *